US006433755B1

(12) United States Patent
Kuramoto

(10) Patent No.: US 6,433,755 B1
(45) Date of Patent: Aug. 13, 2002

(54) HELICAL ANTENNA

(75) Inventor: Akio Kuramoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/830,422

(22) PCT Filed: Oct. 28, 1999

(86) PCT No.: PCT/JP99/05958

§ 371 (c)(1),
(2), (4) Date: Apr. 26, 2001

(87) PCT Pub. No.: WO00/26990

PCT Pub. Date: May 11, 2000

(30) Foreign Application Priority Data

Oct. 30, 1998 (JP) ..... 10-309288

(51) Int. Cl.[7] ..... H01Q 1/36
(52) U.S. Cl. ..... 343/895
(58) Field of Search ..... 343/702, 876, 343/895; H01Q 1/36

(56) References Cited

U.S. PATENT DOCUMENTS

| | | | | |
|---|---|---|---|---|
| 4,554,554 A | | 11/1985 | Olesen et al. | 343/895 |
| 5,274,388 A | * | 12/1993 | Ishizaki et al. | 343/725 |
| 5,694,140 A | * | 12/1997 | Waterman et al. | 343/895 |
| 6,169,523 B1 | * | 1/2001 | Ploussios | 343/895 |
| 6,222,505 B1 | * | 4/2001 | Endo et al. | 343/895 |
| 6,249,262 B1 | * | 6/2001 | Lee et al. | 343/895 |

FOREIGN PATENT DOCUMENTS

| | | |
|---|---|---|
| JP | 49-61423 | 5/1974 |
| JP | 58-138102 | 8/1983 |
| JP | 62-186509 | 11/1987 |
| JP | 4-213907 | 8/1992 |
| JP | 5-206719 | 8/1993 |
| JP | 6-502286 | 3/1994 |
| JP | 6-81118 | 11/1994 |
| JP | 8-321716 | 12/1996 |
| JP | 9-51227 | 2/1997 |
| JP | 10-75193 | 3/1998 |
| JP | 10-509577 | 9/1998 |
| WO | WO 97/11507 | 3/1997 |

* cited by examiner

*Primary Examiner*—Tho G Phan
(74) *Attorney, Agent, or Firm*—Young & Thompson

(57) ABSTRACT

In a radiation element comprising helical element (1), diode (2), and helical element (3), since helical element (1) is insulated from helical element (3) for a high-frequency signal when diode (2) is off, only helical element (1) operates as a radiation element. In the radiation element comprising helical element (1), diode (2), and helical element (3), since there is conductivity between helical elements (1) and (3) for a high-frequency when diode (2) is on, helical elements (1) and (3) operate as connected.

20 Claims, 10 Drawing Sheets return loss

HELICAL ANTENNA

BACKGROUND OF THE INVENTION

1. Field of the Invention

The present invention relates to a helical antenna, and more particularly to a helical antenna optimal as an antenna for a mobile satellite communication terminal, a satellite-based portable terminal, or a satellite portable telephone.

2. Description of the Related Art

Conventionally, a quadrifillar helical antenna including four helical radiation elements is known as a helical antenna of this type. The quadrifillar helical antenna, however, has a problem of a complicated structure to cause susceptibility to vibration and shock.

Particularly, an antenna for use in a mobile satellite communication terminal, a satellite-based portable terminal, or a satellite portable telephone requires a wide directivity and a structure resistant to shock and vibration and suitable for placement on such a terminal or the like. It is thus difficult to use the aforementioned quadrifillar helical antenna in these communication terminals or portable telephone.

To address this, a helical antenna described in Japanese Patent Laid-open Publication No. Hei 5-206719 comprises a power distributor with a plane configuration for dividing a high-frequency signal into four and four radiation elements connected to four output terminals of the power distributor and disposed helically on the periphery of a cylindrical dielectric member such that the radiation elements are supported with a simple structure and with high rigidity.

The helical antenna described in that official gazette enables a reduced distance between each output terminal of the power distributor and a point where each radiation element is excited, and the power distributor has the plane configuration to improve impedance characteristics, thereby allowing a reduction in power supply loss.

Since the power distributor with the plane configuration can accurately control a power dividing ratio and phase differences among respective divided powers, distortion of directivity can be suppressed. In addition, if a matching element is provided at a connecting point of the power distributor to each radiation element, favorable impedance characteristics can be obtained in several percents of the frequency range to allow a reduced matching loss.

In the conventional helical antenna mentioned above, the helical antenna described in the aforementioned official gazette has the wide directivity and the structure resistant to shock and vibration and suitable for placement on a terminal or the like. The antenna is thus optimal as an antenna for a mobile satellite communication terminal, a satellite-based potable terminal, or a satellite portable telephone, but its bandwidth cannot be increased with the same size maintained.

To increase a bandwidth in such a configuration with the same size maintained, an approach has been proposed in recent years in which two different kinds of quadrifillar antennas, i.e. a total of eight radiation elements are provided together to increase the bandwidth. In this approach, however, spacings between the respective radiation elements are extremely small to increase mutual coupling. Thus, radiated radio waves are coupled to the adjacent element to reduce the radiation efficiency, or the influence of the adjacent radiation element narrows the band in frequency characteristics for input impedance to cause a reduced gain and efficiency of the antenna.

In view of the foregoing, it is an object of the present invention to provide a helical antenna capable of solving the aforementioned problems, usable at two different frequencies, and increasing its bandwidth.

SUMMARY OF THE INVENTION

A helical antenna according to the present invention comprises a radiation element helically disposed and including a first radiation element disposed on a lower portion of a dielectric member, a second radiation element disposed on an upper portion of the dielectric element, and a switching element for connection and disconnection between the first radiation element and the second radiation element.

Another helical antenna according to the present invention comprises N (N is a positive integer) sets of radiation elements, each of the radiation elements including a first conductor helically disposed on a periphery of a dielectric member in cylindrical shape, a diode for switching having one end connected to an upper end of the first conductor, and a second conductor helically disposed on the periphery of the dielectric member in cylindrical shape and connected to the other end of the diode, wherein the N sets of radiation elements are arranged in the circumferential direction of the same cylinder with the same spacings between them.

In other words, the helical antenna according to the present invention includes the switching element such as a diode interposed at some midpoint in the helical electromagnetic radiation conductor included by the helical antenna and switches the switching element, thereby changing the resonance frequency to allow the helical antenna to be used at two switched frequencies as required.

Therefore, since the helical antenna of the present invention can be used at two frequencies by switching of the diode or the like in a system which does not perform transmission and reception simultaneously, it is possible to increase a bandwidth in the helical antenna configuration with the similar size maintained.

DETAILED DESCRIPTION OF THE PREFERRED EMBODIMENTS

Figure 1A:
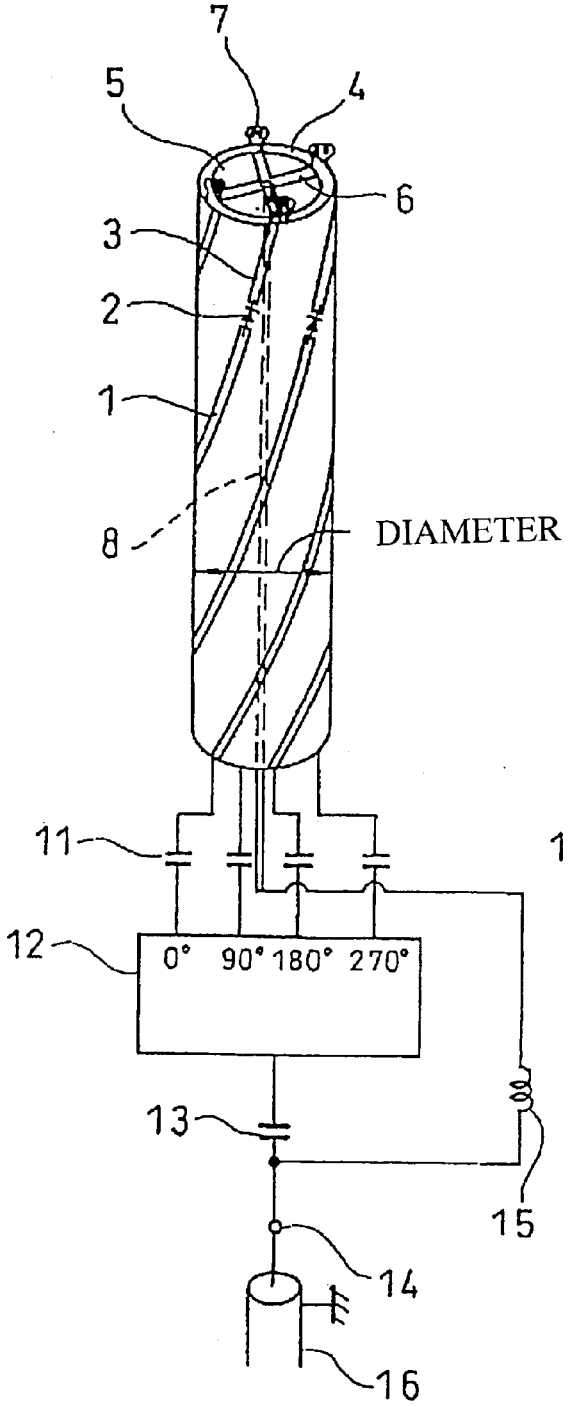
FIG. 1*a* is a perspective view of a helical antenna according to an embodiment of the present invention.
Figure 1B:
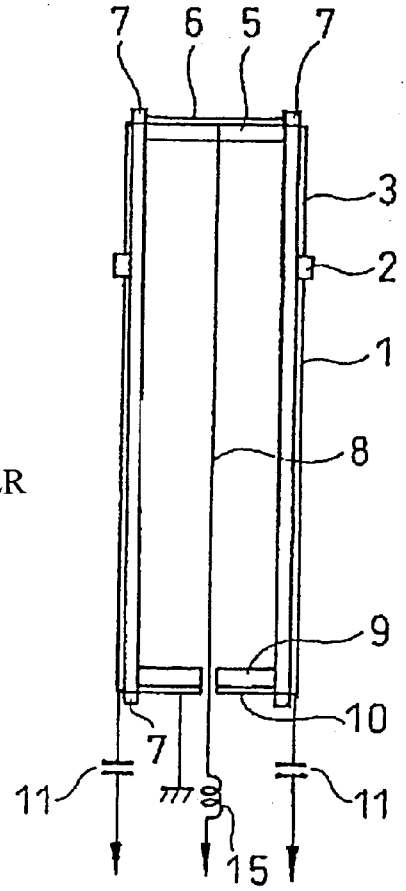
FIG. 1*b* is a longitudinal cross-sectional view of the helical antenna in FIG. 1*a;*

Next, preferred embodiments of the present invention are described with reference to the drawings. FIG. 1(*a*) is a perspective view of a helical antenna according to an embodiment of the present invention, and FIG. 1(*b*) is a longitudinal cross-sectional view of the helical antenna in FIG. 1*a*.

In these figures, helical element 1 is formed of a helical conductor and connected to helical element 3 through diode 2 provided for the purpose of switching. Thus, helical element 1, diode 2, and helical element 3 constitute one radiation element. The radiation element is formed such that it is wound around cylinder 4 formed of a dielectric.

In this embodiment, four radiation elements are present to constitute a so-called four-element helical antenna. Discs 5 and 9 formed of dielectric substrates are fitted to the upper end and the lower end of dielectric cylinder 4, respectively. Conductor patterns 6 and 10 in cross shape are formed on the upper surface of disc 5 disposed at the upper end of cylinder 4 and on the lower surface of disc 9 disposed at the lower end of cylinder 4, respectively.

Inductors 7 are connected at the connecting points between the ends of helical elements 1 and 3 and the ends of patterns 6 and 10, respectively. Holes are formed at the center of disc 5 and pattern 6, and at the center of disc 9 and pattern 10, respectively.

Rod 8 formed of a metal conductor extends from the bottom of lower disc 9 to the top of upper disc 5 where it is soldered at the center of pattern 6. The lower end of rod 8 is connected to input/output port 14 through inductor 15. The lower ends of helical elements 1 are connected to power supply circuit 12 through capacitors 11, and simultaneously, connected through inductors 7 to the ends of pattern 10 formed on the lower surface of lower disc 9, respectively. Power supply circuit 12 is connected to input/output port 14 through capacitor 13.

For specific outer dimensions, 0.07 to 0.25 wavelength is often used as the diameter of dielectric cylinder 4. The dielectric constant of cylinder 4 is preferably 3 or lower, and the thickness thereof is preferably 1/100 wavelength or lower. The height of cylinder 4 is determined by the sum of the length of helical element 1 and the length of helical element 3. The length is generally an integral multiple of ¼ wavelength of the lowest frequency to be used.

For example, when helical elements 1 and 3 have the length of ¼ wavelength, the height of cylinder 4 never exceeds ¼ wavelength since helical elements 1 and 3 are inclined with respect to the axial direction of cylinder 4. For inductors 7 and 15 or capacitors 11 and 13, a box-shape component with a side of approximately 1 mm to 2 mm in length, called a chip inductor or a chip capacitor, is often used. Input/output port 14 is connected to a transmit/receive section (not shown), for example through coaxial cable 16 or the like.

Figure 2:
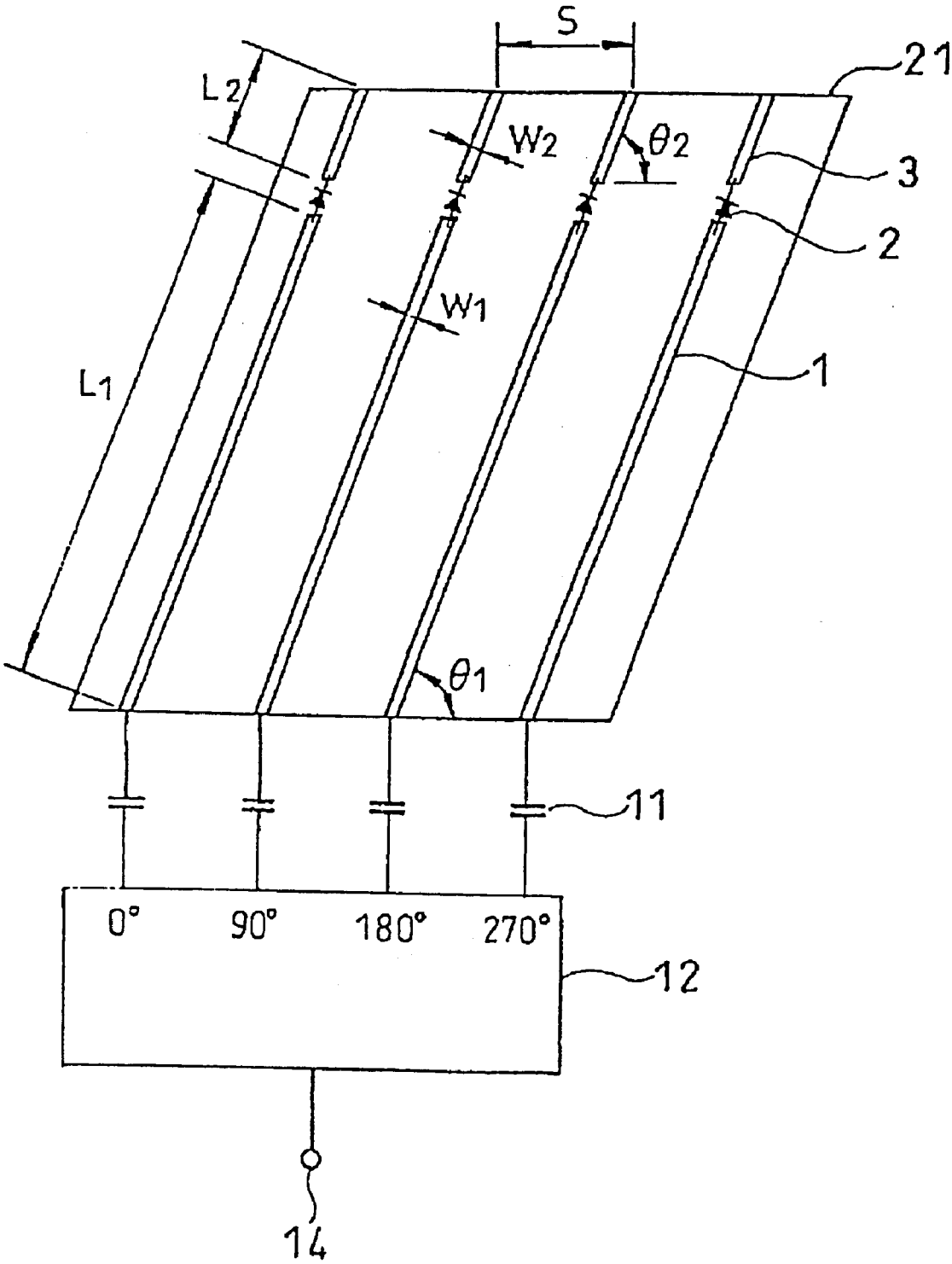
FIG. 2 is a developed view showing the configuration of the helical antenna in FIG. 1*a;*

FIG. 2 is a developed view showing the configuration of helical elements 1 and 3 in FIG. 1*a*. FIG. 2 shows an embodiment in which helical elements 1 and 3 are formed by etching thin film substrate 21. The helical antenna according to the embodiment may be obtained by winding this film substrate 21 around cylinder 4.

Diode 2 is connected between helical elements 1 and 3, and the helical antenna is formed of four sets of such diode 2 and helical elements 1 and 3 placed at equal spacings. These four sets of helical elements 1 and 3 are disposed in parallel with one another, and spacing S in a direction perpendicular to the cylinder axis is represented by $S=\pi D/4$ where D is the diameter of cylinder 4.

Inclinations θ1 and θ2 of helical elements 1 and 3 may be the same or different from each other. For inclinations θ1 and θ2, values of approximately 65 to 75 degrees are selected when diameter D is approximately 0.08 wavelength.

Widths W1 and W2 of helical elements 1 and 3 may be the same or different from each other. Typically, widths W1 and W2 are approximately 1 to 3 mm when a wavelength used is 100 mm or longer. Helical elements 1 are connected at their lower ends to power supply circuit 12 through capacitors 11 operating for bias blocking and impedance matching. Power supply circuit 12 has four ports for supplying powers, each power having a different excitation phase by 90 degrees from adjacent ports and an equal excitation amplitude.

Figure 3A:
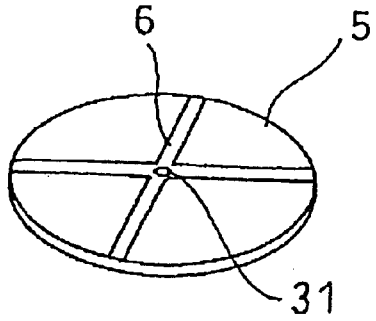
FIG. 3*a* shows the top of disc 5 in FIG. 1*a* in detail.
Figure 3B:
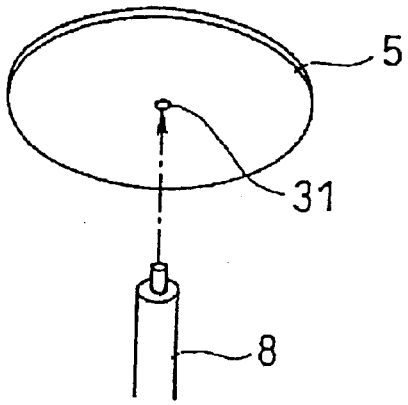
FIG. 3*b* shows the bottom of disc 5 in FIG. 1*a* in detail.
Figure 3C:
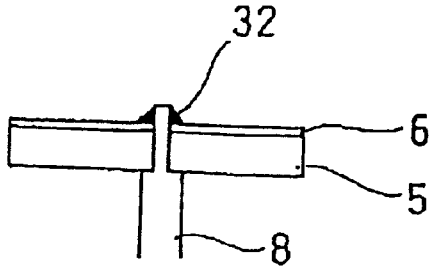
FIG. 3*c* shows the cross section of disc 5 in FIG. 1*a* in detail.

FIG. 3*a*, FIG. 3*b*, and FIG. 3*c* show the top, bottom, and cross section of disk 5 in detail, respectively.

Disc 5 is formed of a dielectric substrate. Conductor pattern 6 in cross shape is formed on the top thereof as shown in FIG. 3*a*. Hole 31 is formed at the center of disc 5.

FIG. 3*b* shows the bottom of disc 5. Disc 5 is formed such that the end of conductor rod 8 is passed through hole 31 from below. Conductor rod 8 is fixed by soldering 32 as shown in FIG. 3*c*.

Figure 4A:
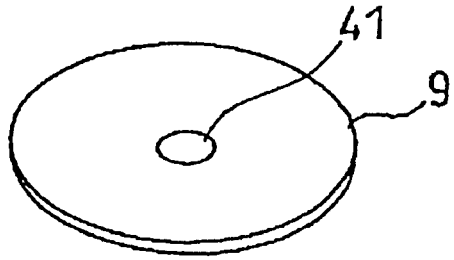
FIG. 4*a* shows the top of disc 9 in FIG. 1*b* in detail.
Figure 4B:
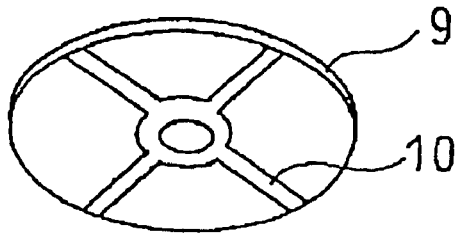
FIG. 4*b* shows the bottom of disc 9 in FIG. 1*b* in detail.
Figure 4C:
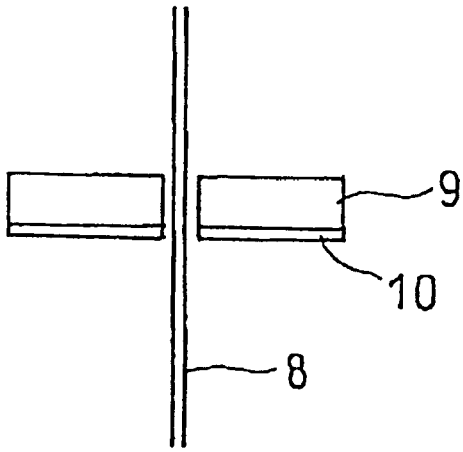
FIG. 4*c* shows the cross section of disc 9 in FIG. 1*b* in detail.

FIG. 4*a*, FIG. 4*b*, and FIG. 4*c* show the top, bottom, and cross section of disc 9 in detail, respectively.

Disc 9 fitted to the bottom of cylinder 4 is formed of a dielectric substrate, and hole 41 is formed therethrough as shown in FIG. 4*a*. Hole 41 has a diameter such that conductor rod 8*a* is not in electrical contact therewith.

FIG. 4*b* shows the bottom of disc 9, and conductor rod 8 passes through hole 41 from below. Conductor rod 8 extends through disc 9 from below as shown in FIG. 4*c*.

Figure 5A:
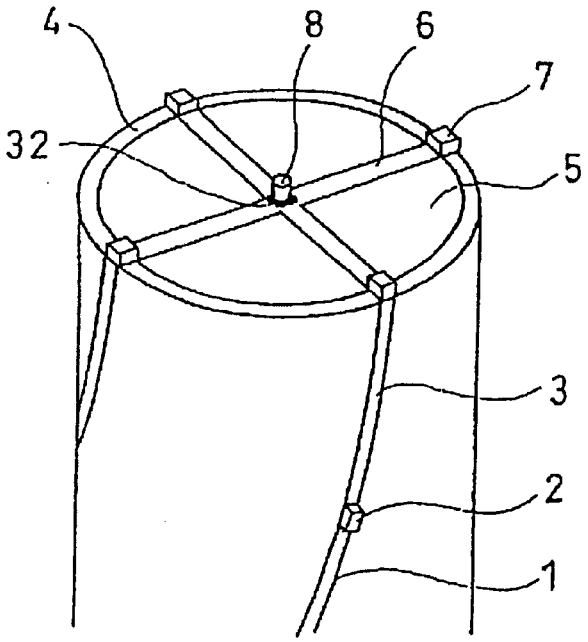
FIG. 5*a* shows connecting points of helical elements 3 to disc 5 in FIG. 1 in detail.
Figure 5B:
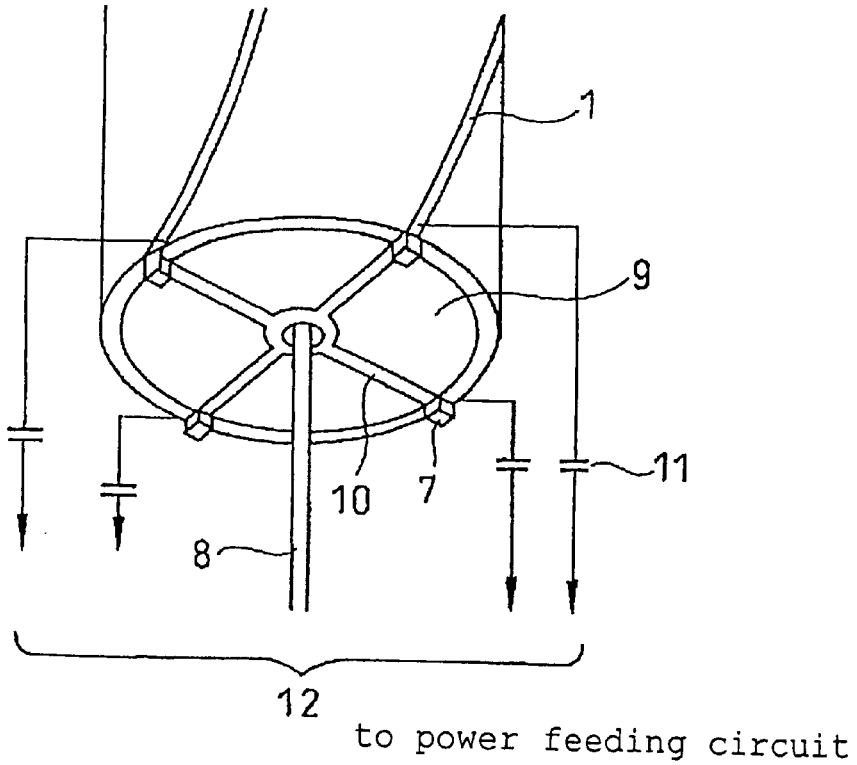
FIG. 5*b* shows connecting points of helical elements 1 in FIG. 1*a* to disc 9 in FIG. 1*b* in detail.

FIG. 5*a* shows connecting points of helical elements 3 to disc 5 in detail, while FIG. 5*b* shows connecting points of helical elements 1 to disc 9 in detail.

Inductors 7 are connected between the ends of helical elements 3 and the ends of pattern 6 on disc 5 fitted to the top of cylinder 4. Rod 8 extending from below is fixed at the center of pattern 6 by soldering 32.

Inductors 7 are also connected between the ends of helical elements 1 and the ends of pattern 10 on disc 9 fitted to the bottom of cylinder 4. At the connecting points, helical elements 1 are also connected in parallel to power supply circuit 12 through capacitors 11. Rod 8 passes through the center of pattern 10 from below.

In FIG. 1*a*, helical elements 1 are connected to helical elements 3 through diodes 2, respectively. Four sets of radiation elements formed of helical elements 1, diodes 2, and helical elements 3 are wound on cylinder 4 formed of the dielectric and operate as a four-element helical antenna.

High-frequency power input from input/output port 14 is divided by power supply circuit 12 into four powers with an equal amplitude and different phases from one another by 90 degrees. The divided four powers are supplied to the lower ends of helical elements 1 through capacitors 11, respectively.

In the radiation element formed of helical element 1, diode 2, and helical element 3, since helical elements 1 is insulated from helical element 3 for a high frequency signal when diode 2 is off, only helical element 1 operates as a radiation element. In this case, an integral multiple of ¼ wavelength of the frequency is used as the length of helical element 1.

In the radiation element formed of helical element 1, diode 2, and helical element 3, since there is conductivity between helical elements 1 and 3 for a high frequency when diode 2 is on, helical elements 1 and 3 operate as connected t each other. In this case, the total length as a radiation element is equal to the sum of respective lengths of helical elements 1 and 3, i.e. L1+l2. Thus, resonance occurs n a high-frequency signal at a frequency when L1+L2 is equal to an integral multiple of ¼ wavelength.

For example, two frequencies, F1 equal to 2.2 GHz and F2 equal to 2.0 GHz are used, wavelengths λ1 and λ2 are approximately 136 mm and 150 mm for respective frequencies F1 and F2. If radiation elements are designed to achieve resonance in a high-frequency signal at ¾ wavelength, ¾ wavelengths are 102 mm and 112.5 mm, respectively.

The difference between them is 10.5 mm, and as a result, lengths L1 and L2 of helical elements 1 and 3 may be set to 102 mm and 10.5 mm, respectively. It goes without saying that it is necessary in an actual case to make design in consideration of a wave length reduction rate of a conductor, influence of dielectric cylinder 4, a capacitance component owned by diode 2 or the like.

Next, description is made for a method of providing diode 2 with a bias. When diode 2 is biased, it is necessary to avoid influence on operations at a high frequency of helical elements l and 3.

First, a negative bias voltage (direct current) for driving diode 2 is applied between input/output port 14 and a ground. At this point, while the negative bias current flows toward power supply circuit 12, it does not flow into power supply circuit 12 due to capacitor 13 for direct current blocking but passes through conductor rod 8 through inductor 15, and reaches pattern 6 on disc 5 fitted to the top of cylinder 4.

Then, the negative bias current passes through four helical elements 3 through four inductors 7 on pattern 6, and passes through four diodes 2 to turn them on. The negative bias current further passes through helical elements 1 and pattern 10 on the lower surface of disc 9 at the bottom of cylinder 4 through inductors 7 at the lower ends of helical elements 1 to fall to the ground. In this case, the bias current does not flow into power supply circuit 12 since it is blocked by capacitors 11.

In this manner, helical elements 1 and 3 are electrically connected to each other to serve as a radiation element with the length of L1+L2 when diode 2 is on. When no bias voltage is applied or when a positive bias voltage is applied, diode 2 is off.

When no bias voltage is applied, diodes 2 is not turned on due to no bias current flowing to diode 2. When a positive bias voltage is applied, it serves as a reverse bias for diode 2 and no current flows, and thus diode 2 is not turned on. Diode 2 is off in this case, which means that helical element 3 is not electrically connected to helical element 1, and helical element 1 serves as a radiation element with the length of L1 only.

Thus, the electrical length of the helical elements can be switched between L1+L2 and L1 by applying a bias voltage to input/output port 14 to turn diode 2 on/off together with a high-frequency signal supplied to the antenna. This means that a resonance frequency can be selected from two frequencies.

For example, when ¾ wavelength is used for lengths of the helical elements, frequency F1 presenting resonance at L1 is represented by F1=C/(L1/0.75) where C is the velocity of light, and frequency F2 presenting resonance at L1+L2 is represented by F2=C/((L1+L2)/0.75).

Figure 6:
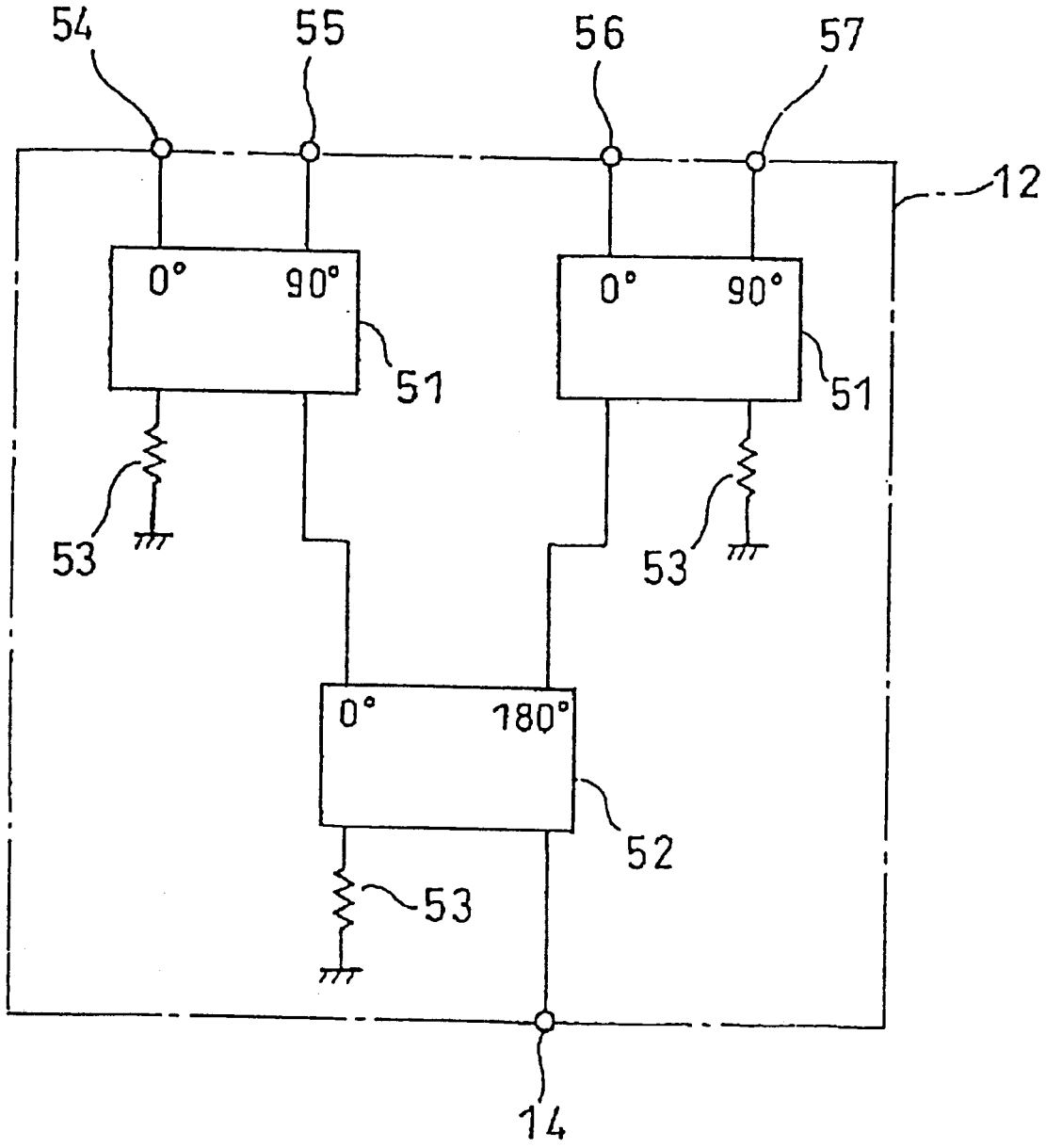
FIG. 6 shows an example of the configuration of power supply circuit 12 in FIG. 1*a;*

When the four-element helical antenna as the embodiment is powered, power supply circuit 12 is required for sequentially supplying helical elements with signals having an equal amplitude and respective phases delayed or advanced by 90 degrees with respect to an adjacent element. FIG. 6 shows an example of the configuration of power supply circuit 12. Power supply circuit 12 comprises two 90 degree hybrids 51 and one 180 degree hybrid 52. Terminating resistor 53 is connected to a dummy port of each of hybrids 51 and 52. With such a configuration, a high-frequency signal input from input/output port 14 is output to ports 54 to 57 as signals having the same amplitude and different phases from one another by 90 degrees.

Description is made for the case of transmission. A high-frequency signal received from input port 14 is divided by 180 degree hybrid 52 into two high-frequency signals having different phases by 180 degrees and an equal amplitude, and the resultant signals are input to two 90 degree hybrids 51, respectively.

Then, each of these high-frequency signals is further divided by each hybrid 51 into two high-frequency signals having different phases by 90 degrees and an equal amplitude, and the resultant signals are output to ports 54 to 57. In this manner, the divided high-frequency signals are taken out as high-frequency signals having the same amplitude but respective phases advanced by 90 degrees sequentially.

Figure 7:
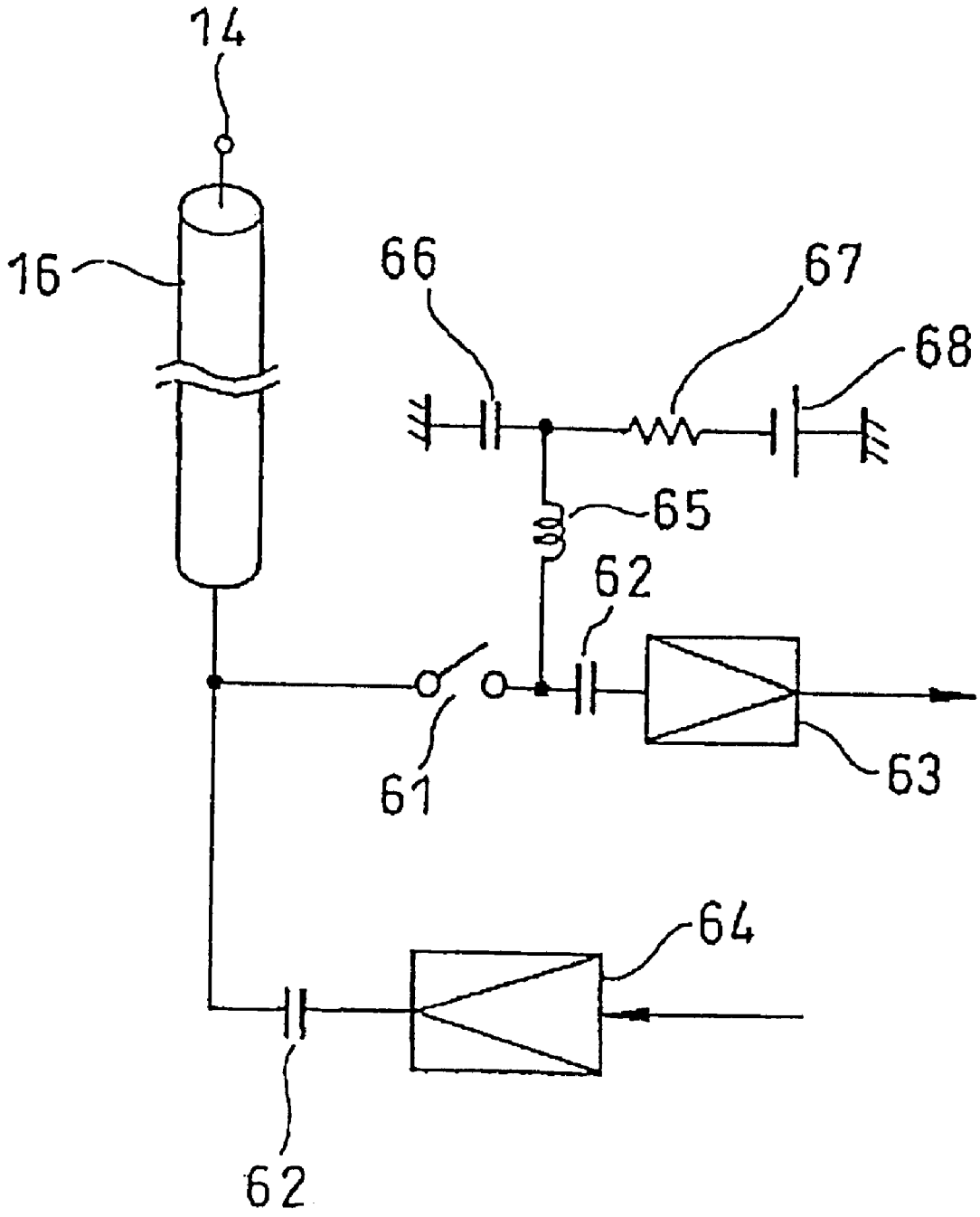
FIG. 7 shows an example application of the helical antenna according to one embodiment of one present invention.

FIG. 7 shows an example application of the helical antenna according to the embodiment. FIG. 7 shows an example of a high-frequency circuit (an RF input section of a transceiver) for efficient use of the helical antenna of the embodiment which is used, for example, through coaxial cable 16 connected to input/output port 14 of the helical antenna.

In a receiving system of the high-frequency circuit, a received signal is input from the lower end of coaxial cable 16 to low noise amplifier 63 through switch 61 and capacitor 62. On the other hand, in a transmitting system of the high-frequency circuit, an output from power amplifier 64 is directly connected to the lower end of coaxial cable 16.

In the aforementioned receiving system, a negative terminal of DC power source 68 is connected between switch 61 and capacitor 62 through inductor 65 and resistance 67. A positive terminal of DC power source 68 is grounded. Also, the DC power source side of inductor 65 is grounded for a high-frequency signal by capacitor 66.

In the aforementioned high-frequency circuit, the upper end of coaxial cable 16 is connected to input/output port 14 of the helical antenna shown in FIG. 1*a*. Power source 68 for a negative direct current bias applied to diode 2 of the helical antenna has the positive side grounded and the negative side connected to the input to low noise amplifier 63 serving as a low noise amplifier for reception through resistance 67 for current limiting and inductor 65.

Inductor 65 and capacitor 66 are added to prevent a high-frequency signal from flowing toward the bias DC power source. Capacitor 62 is provided for direct current blocking to prevent a bias current from flowing toward the input to low noise amplifier 63. Capacitor 62 connected to the output side of power amplifier 64 serving as a high-frequency power amplifier is also provided for direct current blocking to prevent the bias from flowing to power amplifier 64.

When the helical antenna receives a signal, switch 61 is closed after the end of the operation of a high-frequency power amplifier for transmission. A bias current passes through closed switch 61 to reach input/output port 14 through coaxial cable 16.

Then, as described above, the current reaches diode 2 through inductor 15, rod 8, pattern 6, inductors 7, and helical elements shown in FIG. 1. Diodes 2 are then turned on, and a received signal at a frequency presenting resonance at the length of L1+L2 is received by the radiation elements formed of helical elements 1, diodes 2, and helical elements 3. The signal passes through capacitors 11, is combined at power supply circuit 12, and reaches the input to low noise amplifier 63 after it passes through capacitor 13, input/output port 14, coaxial cable 16, switch 61, and capacitor 62.

In this case, inductors 7, 15, and 65 are selected to present sufficiently high impedance for the frequency of the received signal for preventing the received signal inflow. Similarly, capacitors 11, 13, 62, and 66 are selected to present sufficiently low impedance for the frequency of the received signal for allowing the received signal to pass without attenuation. However, an appropriate value need be selected for capacitors 11 when they are responsible for impedance matching with helical element 1.

When the helical antenna transmits a signal, switch 61 is off, and power amplifier 64 serving as a high-frequency power amplifier is operated. Since switch 61 is open, the high-frequency power from power amplifier 64 does not flow into low noise amplifier 63 to damage it, and the power passes through coaxial cable 16 to input/output port 14.

The high-frequency power then passes capacitor 13, power supply circuit 12, and capacitors 11, and then is supplied to helical elements 1. In this case, since switch 61 is open, the bias current does not flow through diode 2 and diode 2 remains off. Thus, helical element 3 is isolated from helical element 1 for the high-frequency power, and the high-frequency power from power amplifier 64 flowing to the helical elements is efficiently radiated at the resonance frequency for L1 which is the length of helical element 1.

In the transmission operation, inductors 7, 15, and 65 are also selected to present sufficiently high impedance for the frequency of the transmission signal for preventing the transmission signal inflow. Capacitors 11, 13, 62, and 66 are selected to present sufficiently low impedance for the frequency of the transmission signal for allowing the transmission signal to pass without attenuation. However, an appropriate value need be selected for capacitors 11 when they are responsible for impedance matching with helical element 1.

Figure 8:
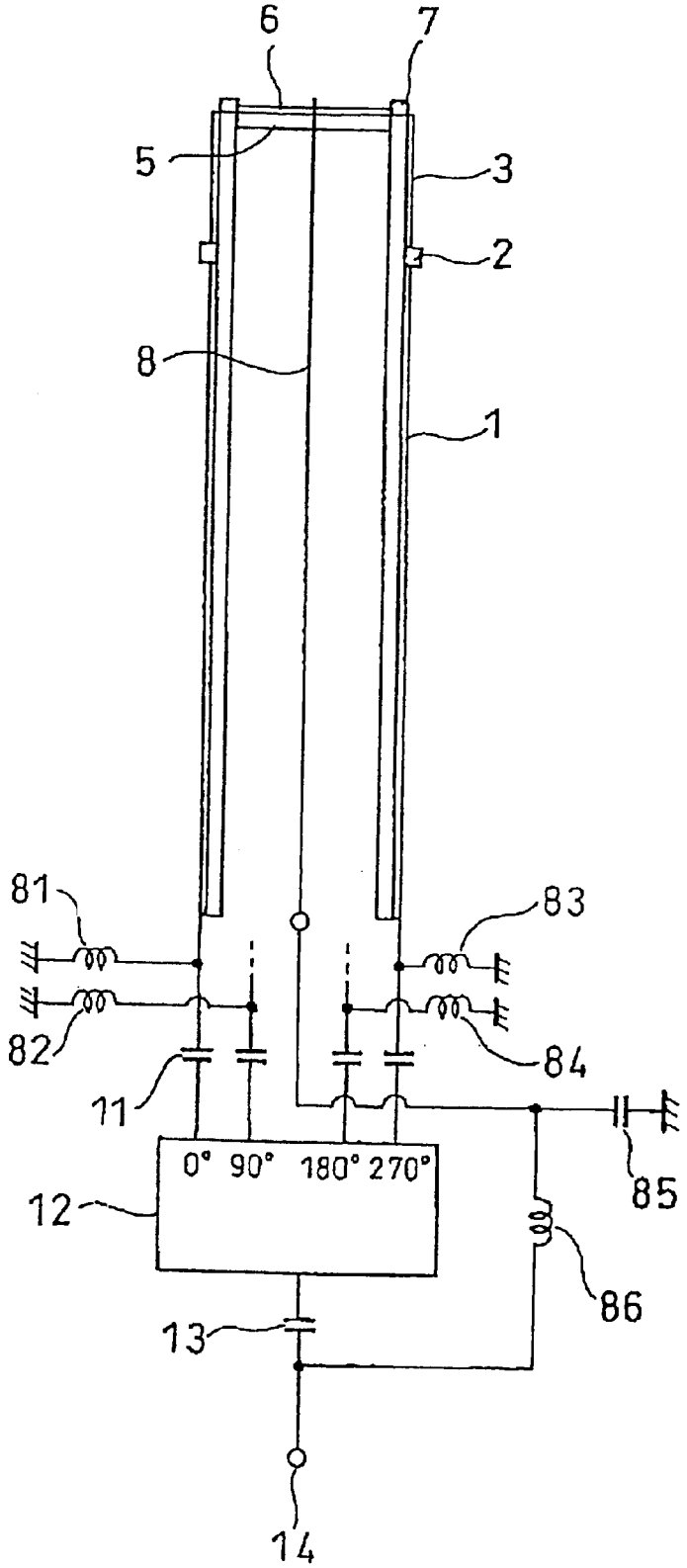
FIG. 8 is a longitudinal cross-sectional view of a helical antenna according to the other embodiment of the present invention.

FIG. 8 is across-sectional view of a helical antenna according to another embodiment of the present invention. The helical antenna according to the embodiment differs from the embodiment shown in FIG. 1*a* in that the former does not have a disc corresponding to disc 9 in FIG. 1*a* and instead has inductors 81 to 84 each of which is connected at one end to the lower end of helical element 1 and connected at the other end to the ground.

Inductor 86 has one end connected to input/output port 14 of the helical antenna and the other end connected to the ground through capacitor 85 as well as the lower end of rod 8.

The helical antenna according to the embodiment can be used in resonance at two frequencies by applying a bias voltage to diode 2 for switching. Specifically, the application of a bias to diode 2 turns diode 2 on/off to allow helical elements 1 and 3 to be used at two resonance frequencies in accordance with the length of L1+L2 or the length of L1 similarly to the embodiment in FIG. 1*a*.

The biasing in the embodiment in FIG. 8 slightly differs from that of the embodiment in FIG. 1*a*. Specifically, the embodiment shown in FIG. 8 has no component corresponding to disc 9 in FIG. 1*a* and instead uses inductors 81 to 84. In the embodiment in FIG. 1*a,* a bias current superimposed at input/output port 14 reaches helical elements 1 through inductor 15, rod 8, pattern 6, inductors 7, helical elements 3, and diodes 2, and then is connected to the ground through inductors 7 and pattern 10.

In the embodiment in FIG. 8, however, a bias current superimposed at input/output port 14 reaches helical elements 1 through inductor 86, rod 8, pattern 6, inductors 7, helical elements 3, and diodes 2, and then is connected to the ground after it passes through inductors 81 to 84.

The embodiment, as compared with the embodiment shown in FIG. 1*a,* does not need disc 9 and instead requires inductors 81 to 84. The embodiment in FIG. 8 is similar to that in FIG. 1*a* in that the antenna can be used at two frequencies by turning diode 2 on/off. When a product is realized, either of the embodiments which can be easily performed or which can provide more favorable performance may be selected.

Figure 9:
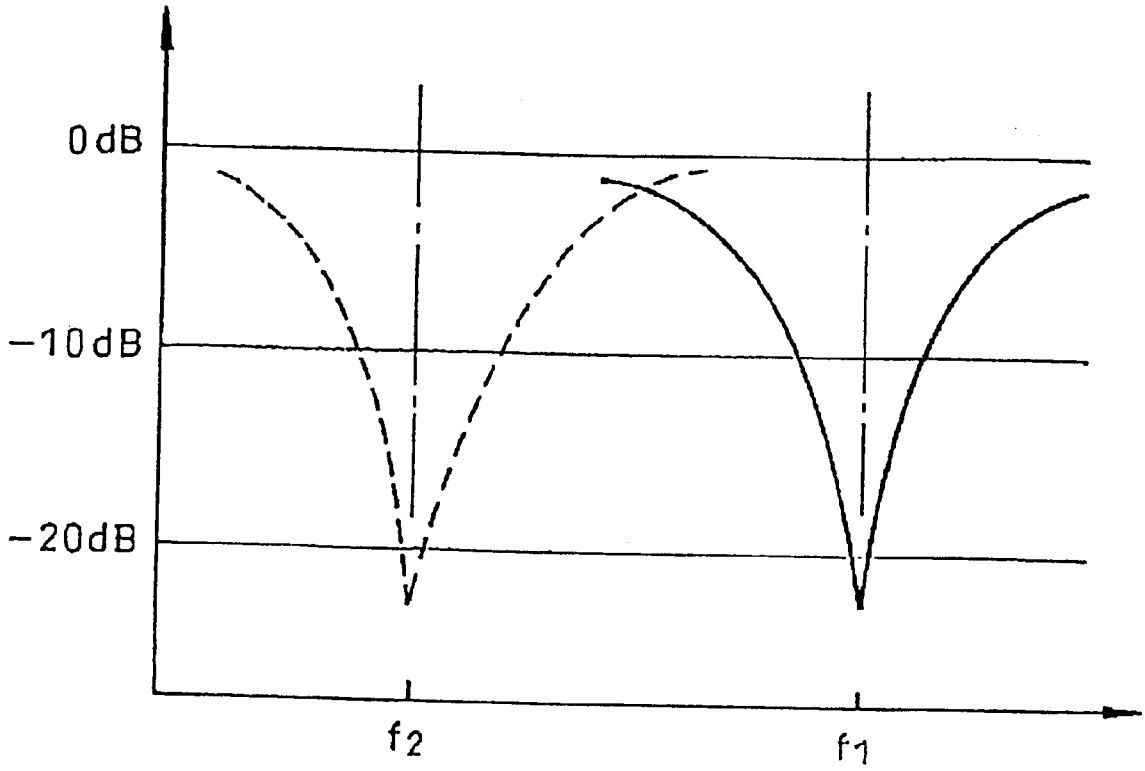
FIG. 9 is a graph showing an example of return loss characteristics of the helical antenna of the present invention.

FIG. 9 is a graph showing an example of return loss characteristics of the helical antenna of the present invention. FIG. 9 shows an example of return loss characteristics at frequency F1 presenting resonance at L1 and at frequency F2 presenting resonance at L1+L2 when diode 2 is turned on/off. A solid line shows the characteristic when diode 2 is off, while a dotted line shows the characteristic when diode 2 is on.

Figure 10:
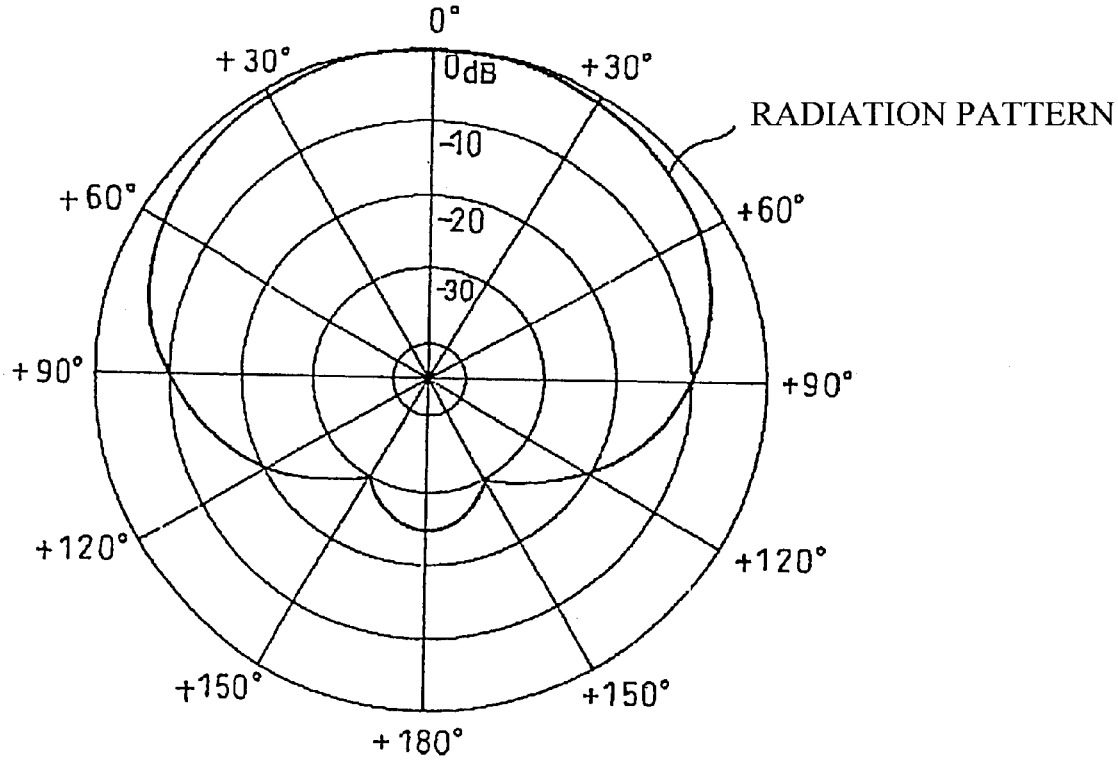
FIG. 10 shows an example of the radiation pattern in an elevation angle plane of the helical antenna of the present invention.

FIG. 10 shows an example of the radiation pattern in an elevation angle plane of the helical antenna of the present invention. FIG. 10 shows an example of the radiation pattern in the elevation angle plane when the top of the helical antenna shown in FIG. 1*a* is pointed to the zenith.

Since the helical antenna of the present invention is intended primarily for use as an antenna of a portable terminal using a satellite system, the radiation pattern as shown in FIG. 10 for obtaining a substantially uniform antenna gain in an upper hemisphere is effective. The satellite system often employs a transmission frequency largely deviated from a reception frequency, and in such a case, the technique of the present invention is indispensable.

In this manner, diode 2 is inserted at some midpoint in the helical electromagnetic radiation conductor included in the helical antenna and a bias is applied to diode 2 for switching, thereby changing the resonance frequency to allow the helical antenna to be used at two switched frequencies as required.

Thus, since the helical antenna of the present invention can be used at two frequencies by switching diode 2 in a system which does not perform transmission and reception simultaneously, it is possible to increase a bandwidth in the helical antenna configuration with the similar size maintained. While the foregoing description has been made for a case where four sets of radiation elements are used, the present invention is applicable to a case where one set, two sets, eight sets, or other number of sets of radiation elements are used. In addition, while the foregoing description has been made for the configuration in which the radiation elements are wound on the cylinder formed of the dielectric, the present invention is also applicable to a configuration in which radiation elements are disposed simply in helical shape.

As described above, according to the present invention, in the helical antenna having the helically disposed radiation elements, each radiation element comprises the first radiation element disposed on the lower portion of the dielectric member, the second radiation element disposed on the upper portion of the dielectric member, and the switching element for connection and disconnection between the first radiation element and the second radiation element. Thus, it is possible to obtain an antenna which can be used at two frequencies without increasing the size of the device and readily increase its bandwidth.

What is claimed is:

1. A helical antenna, comprising:

a radiation element helically disposed on a periphery of a dielectric member and including a plurality of first radiation elements disposed on a lower portion of said dielectric member, a plurality of second radiation elements disposed on an upper portion of said dielectric member, and a switching element interposed between each said first radiation element and a respective said second radiation element for connection and disconnection thereof, wherein each of the length of said first radiation element and the sum of the lengths of said first radiation element and said second radiation element is an integral multiple of ¼ wavelength of a signal at each frequency use; and wherein for every condition of the switching elements, all of the first radiation elements are electrically isolated from one another by first AC isolation devices.

2. The helical antenna according to claim 1, wherein said radiation element is helically disposed on a periphery of the dielectric member in cylindrical shape.

3. The helical antenna according to claim 2, further comprising means for controlling a switching operation of connection and disconnection between said first radiation element and said second radiation element by said switching element.

4. The helical antenna according to claim 3, wherein said switching element comprises a diode for switching.

5. The helical antenna according to claim 4, wherein a bias current is applied to said diode to perform the switching operation of connection and disconnection between said first radiation element and said second radiation element.

6. The helical antenna according to claim 2, wherein said switching element comprises a diode for switching.

7. The helical antenna according to claim 6, wherein a bias current is applied to said diode to perform the switching operation of connection and disconnection between said first radiation element and said second radiation element.

8. The helical antenna according to claim 1, further comprising means for controlling a switching operation of connection and disconnection between said first radiation element and said second radiation element by said switching element.

9. The helical antenna according to claim 8, wherein said switching element comprises a diode for switching.

10. The helical antenna according to claim 9, wherein a bias current is applied to said diode to perform the switching operation of connection and disconnection between said first radiation element and said second radiation element.

11. The helical antenna according to claim 1, wherein said switching element comprises a diode for switching.

12. The helical antenna according to claim 11, wherein a bias current is applied to said diode to perform the switching operation of connection and disconnection between said first radiation element and said second radiation element.

13. The helical antenna of claim 1, wherein for every condition of the switching elements, all of the second radiation elements are electrically isolated from one another by second AC isolation devices.

14. The helical antenna of claim 13, wherein the first and second AC isolation devices are inductors.

15. A helical antenna comprising:

N (N is a positive integer) sets of radiation elements, each of said radiation elements including a first conductor helically disposed on a periphery of a dielectric member in cylindrical shape, a diode for switching having one end connected to an upper end of first conductor, and a second conductor helically disposed on the periphery of said dielectric member in cylindrical shape and connected to the other end of said diode, wherein said N sets of radiation elements are arranged in the circumferential direction of the same cylinder with a same spacing between the radiation elements, and each of the length of said first conductor and the sum of the lengths of said first conductor and said second conductor is an integral multiple of ¼ wavelength of a signal at each frequency used; and wherein for every condition of the diodes, all of the first conductors are electrically isolated from one another by first AC isolation devices.

16. The helical antenna according to claim 15, wherein said first conductors are supplied with powers having equal amplitude and different phases advanced or delayed sequentially by 360 degrees/N.

17. The helical antenna according to claim 16, further comprising means for switching said diode.

18. The helical antenna according to claim 15, further comprising means for switching said diode.

19. A helical antenna comprising:

a plurality of first helical conductors adapted for connection to a power supply circuit;

a plurality of second helical conductors, each of the second helical conductors arranged and shaped to continue a helical shape of a respective one of the first helical conductors, each of the first helical conductors being connected to a respective one of the second helical conductors through a switching element;

wherein the switching elements can be in only one of a first and second condition, in the first condition the first helical conductors being electrically disconnected from the second helical conductors, in the second condition each of the first helical conductors being electrically connected to a respective said second helical conductor; and wherein in both conditions, all of the first helical conductors are electrically AC-isolated from one another.

20. The helical antenna of claim 19, wherein the switching elements are diodes, the helical antenna further comprising an upper conductive element connected through an inductor to each of the second helical conductors.

* * * * *